US008171593B2

(12) United States Patent
Sprague

(10) Patent No.: US 8,171,593 B2
(45) Date of Patent: May 8, 2012

(54) GOLF TOWEL

(76) Inventor: Edwin J. Sprague, Springfield, PA (US)

( * ) Notice: Subject to any disclaimer, the term of this patent is extended or adjusted under 35 U.S.C. 154(b) by 525 days.

(21) Appl. No.: 12/321,400

(22) Filed: Jan. 20, 2009

(65) Prior Publication Data

US 2009/0193598 A1 Aug. 6, 2009

Related U.S. Application Data

(60) Provisional application No. 61/011,438, filed on Jan. 17, 2008.

(51) Int. Cl.
*A63B 57/00* (2006.01)
*A47L 13/16* (2006.01)

(52) U.S. Cl. ... 15/118; 15/104.93; 15/209.1; 15/229.11; 15/244.3

(58) Field of Classification Search ..... 15/104.93, 15/104.94, 118, 208, 209.1, 210.1, 227, 229.11, 15/244.3
See application file for complete search history.

(56) References Cited

U.S. PATENT DOCUMENTS 1,994,425 A * 3/1935 Weller ..... 15/104.94
5,609,255 A * 3/1997 Nichols ..... 206/576
6,192,543 B1 * 2/2001 Lee ..... 15/118
6,233,774 B1 * 5/2001 Vogt ..... 15/104.93
7,484,262 B2 * 2/2009 Cotton ..... 15/118

* cited by examiner

*Primary Examiner* — Mark Spisich
(74) *Attorney, Agent, or Firm* — Massinger Law Offices

(57) ABSTRACT

A cleaning apparatus for golf equipment and the like, the apparatus having combined abrading, polishing and moisture delivery capabilities which may all be caused to act upon a target object simultaneously while shielding the user from wet and soiled surfaces. In a preferred embodiment, the invention is comprised of two adjoining panels of toweling at least one of which is of the terry variety having a plurality of finger-like loops. A portion of one cloth is integrated with a porous mesh scrubbing material on one side and a non-water-permeable backing on the other. The integration of mesh and cloth produce a grid-like duel-textured surface that provides simultaneous abrading and polishing functionality. To further enhance cleaning ability, means for delivering water to the mesh/cloth layer is disposed between the cloth/mesh layer and backing material. The backing material shields the user's hands and golf glove from the soiled and damp cleaning surface of the apparatus; the first panel of polishing cloth serves as a barrier between the golf bag and the soiled and damp cleaning surface of the second panel.

20 Claims, 3 Drawing Sheets

GOLF TOWEL

RELATED APPLICATION

This application claims the benefit of U.S. Provisional Patent Application No. 61/011,438, filed on Jan. 17, 2008 and entitled, Golf Towel.

FIELD OF THE INVENTION

The present invention relates generally to cleaning apparatus for golf balls and equipment, and more particularly to a golf towel having a dry cleaning surface as well as a scrubbing component with moisture delivery means.

BACKGROUND OF THE INVENTION

Golf clubs and golf balls tend to collect dirt and debris during use. The accumulation of grass, dirt, sand and other matter on the surface of a club or ball can adversely affect the manner in which the ball comes into engagement with the face of the club compromising accuracy, spin and distance. Accordingly, it is common place to clean the surface the ball and club face during play to mitigate undesired flight characteristics.

Terry cloth towels have long been a staple cleaning implement of golfers. Typically, the golf towel is hung from a golf bag so as to be freely accessible to the golfer during play. Although Terry cloth golf towels serve as excellent polishing articles, one shortcoming is that they lack sufficient abrasiveness to clear dirt, sand and other particles from the grooves of the golf club face and from other recesses found about the club surface. In an effort to overcome this shortcoming, many golfers carry a separate brush having bristles sufficiently long and course to dislodge the debris from their equipment. The down side is that this is just another article which must be kept on or in the golf bag.

It is also common practice among golfers to wet their golf towel to facilitate and enhance the cleaning of their equipment. Several problems are attendant with this practice. First, the dirty wet towel often soils the golf bag from which it is suspended or the golfer himself when carrying the bag. Second, the wet towel often transfers moisture to the golfers hands and golf glove which ideally should remain dry during play. Third, the towel often dries out before the completion of the round, particularly in arid climates, and often there is no source of clean water to rewet the towel.

Based on the above, there is a need for a golf equipment cleaning apparatus which has surfaces for both polishing and scrubbing equipment simultaneously, has means for retaining moisture and for delivering moisture to the polishing and scrubbing surfaces of the apparatus, and means for shielding the user's hands and golf bag from the moist surfaces of the apparatus. While the prior art teaches various cleaning articles intended to meet some of these needs, no single article meets all of them.

SUMMARY OF THE INVENTION

The subject apparatus rather broadly provides a golf towel adapted with a scrubbing component having combined abrading, polishing and moisture delivery capabilities which may all be caused to act upon a target object simultaneously. In a preferred embodiment, the apparatus first includes toweling in the form of an elongated sheet of terry cloth material or the like that is folded over upon itself along a fold line or "juncture" to form a first toweling panel, preferably but not essentially rectangular in shape, and a second toweling panel at least partially overlapping the first panel. The second panel is preferably approximately two thirds the length of the first panel and of equal width. First and second panels each include at least one grommet proximate to the fold line for purposes of hanging the apparatus to a golf bag in a manner customary in the trade. Alternative mounting means may also be employed. As an alternative to a single sheet of material folded over upon itself, two separate sheets may be attached to one another such as by sewing along their top edge.

A portion of the second panel, preferably and approximately the bottom one third thereof, is modified with the aforementioned scrubbing component which is multilayered in design. Specifically, a backing of non-permeable material such as vinyl or the like is attached to the front surface of the second panel, that is, the surface which faces away from the first panel. A natural or synthetic sponge is disposed between the front surface of the second panel and the overlying sheet of non-permeable backing. The opposite or rear surface of the second panel includes an abrasive mesh material such as nylon or the like attached thereto, the mesh having a plurality of apertures through which at least some of the finger-like closed loops of the Terry cloth material partially project together forming a grid-like duel-textured surface that has both abrasive and polishing properties.

In use, the end of the second panel which has been modified with the scrubbing component may be soaked in water to saturate the sponge and adjacent Terry cloth. The non-permeable backing sheds water easily and dries quickly to provide a dry gripping surface through which water from the adjacent wet sponge may not penetrate and which enhances water retention of the sponge by lowering it's the amount of surface area exposed to the environment, thereby decreasing evaporation. The backing protects the user's hands from moisture, cleaning agents and other chemicals while the opposing mesh layer permits delivery of moisture through its openings to a target object, such as a golf ball or golf club, via the saturated portion of the cloth projecting there through. The target object may then be dried on either the first panel or on the dry portion of the second panel. The exposed surface of the backing is suitable for receiving printed indicia thereon such as company logos and the like.

It should be appreciated that the scouring apparatus of the invention may also have utility by itself, without a toweling member attached thereto. In other embodiments, the scouring apparatus may depend from toweling in numerous other configurations. For example, the scouring apparatus may have toweling depending from one, two, three or all sides, portions or all which said toweling may be folded in various configurations.

There has thus been outlined, rather broadly, the more important components and features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a cleaning apparatus for golf equipment and the like, the apparatus having combined abrading, polishing and moisture delivery capabilities which may all be caused to act upon a target object simultaneously while shielding the user from wet and soiled surfaces.

This together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 2:
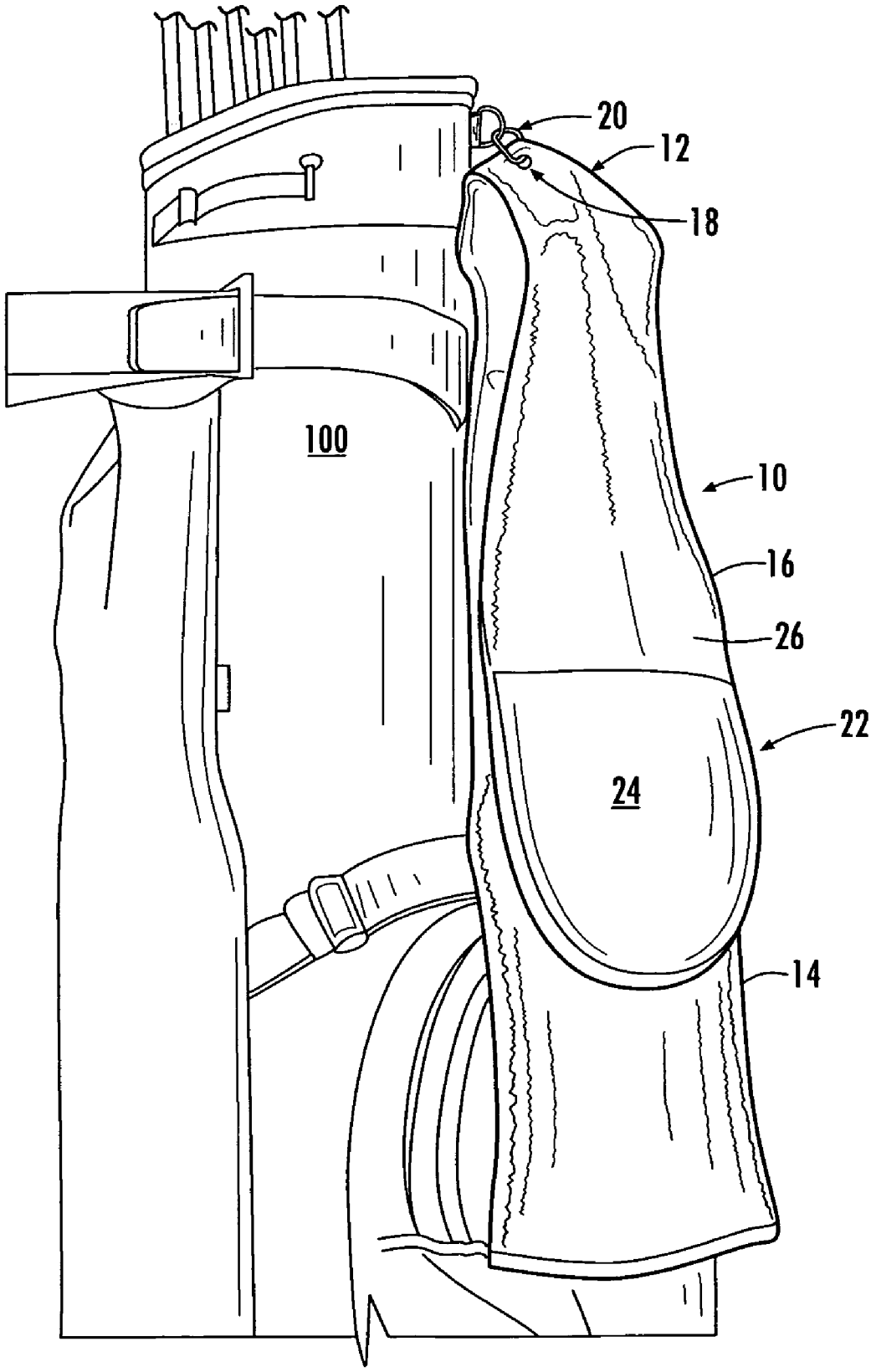
FIG. 2 is a perspective view of a preferred embodiment of the subject golf towel mounted to a conventional golf bag.

Reference is made to FIG. 2 in which a preferred embodiment of the subject golf towel (also referred to as "cleaning apparatus"), denoted generally by reference numeral 10, is illustrated attached to a conventional golf bag 100. Golf towel 10 is comprised very generally of two primary components, namely a toweling component and a scouring apparatus. The toweling component is comprised of an elongated sheet of toweling material, preferably of the terry cloth variety, but in any event having at least one surface bearing a plurality of projections extending there from such as the finger-like loops of terry cloth material which possess excellent moisture absorbing and polishing characteristics. In at least one embodiment the toweling component is folded over upon itself along a fold line or "juncture" 12 to form first toweling panel 14 (also referred to herein as "first panel") and second toweling panel 16 (also referred to herein as "second panel"). First and second toweling panels 14 and 16, respectively, are preferably but not essentially rectangular in shape. Second toweling panel 16 may have a curved or tapered end as illustrated, and at least partially overlaps first panel 14 as shown. Second panel 16 is approximately two thirds the length of the first panel 14 and of equal width. As an alternative to a single sheet of material folded over upon itself, two separate sheets may be attached to one another such as by sewing along their top edge.

The subject golf towel 10 includes mounting means to facilitate its temporary attachment to a golf bag or golf cart. In one embodiment, mounting means may be comprised of at least one grommet 18 fixedly attached to first and second panels 14, 16 proximate to fold line 12, as well as a conventional fastening ring 20. Alternative mounting means may also be employed.

A portion of the toweling component, particularly second panel 16, and preferably and approximately the bottom one third (⅓) thereof, is modified with the aforementioned scouring apparatus which is multilayered in design and designated generally by reference numeral 22. Specifically, a backing 24 of non-permeable material such as vinyl or the like is attached to the front surface 26 of second panel 16, that is, the surface which faces away from first panel 14. Backing 24 is smooth in texture, sheds water easily and provides a surface suitable for receiving printed indicia such as Country Club logos or other information in an infinite variety of colors and designs. The subject apparatus, therefore, serves as an ideal fulfillment item.

Figure 1:
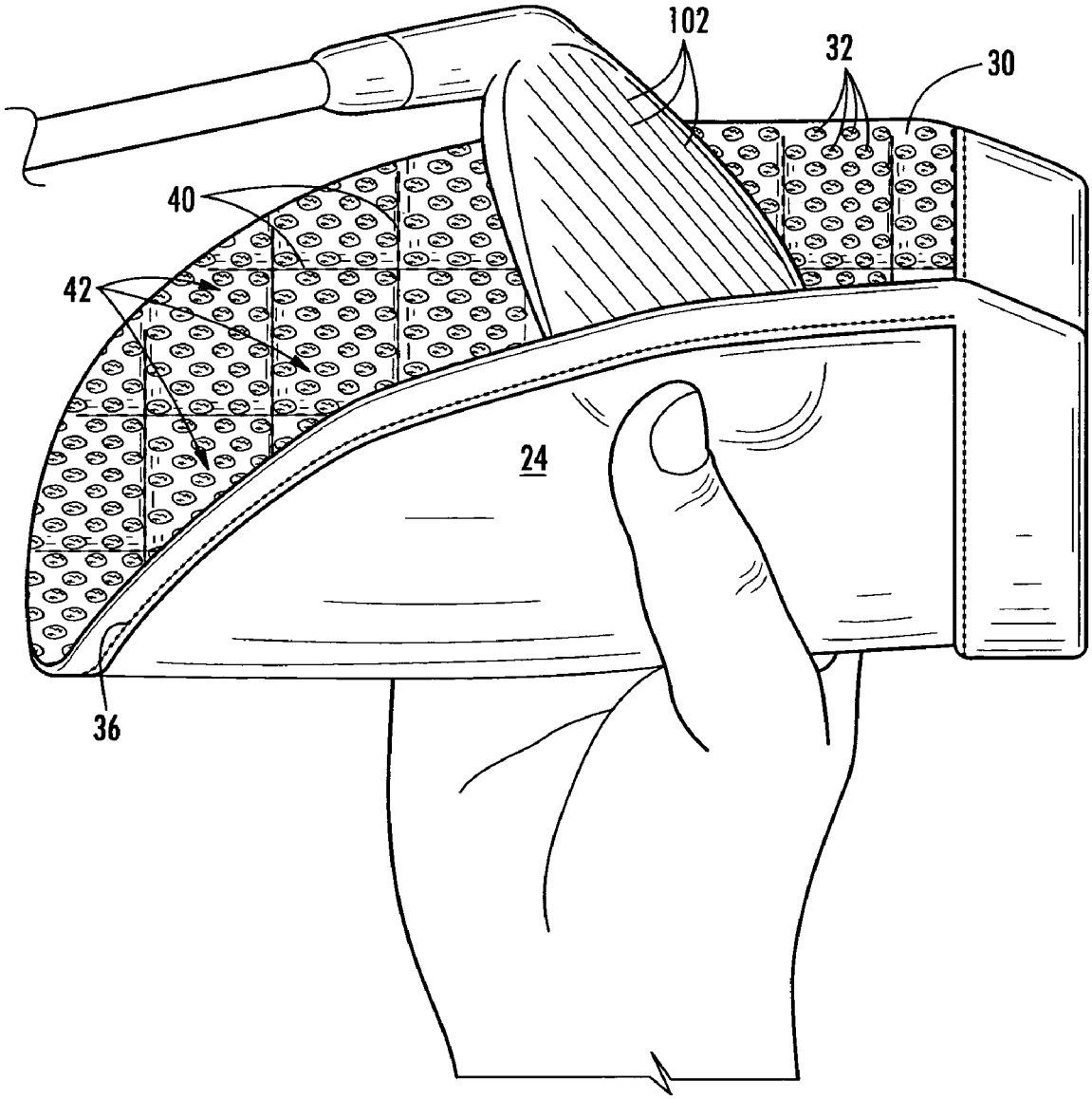
FIG. 1 is an enlarged view of the scouring apparatus of the subject invention.
Figure 3:
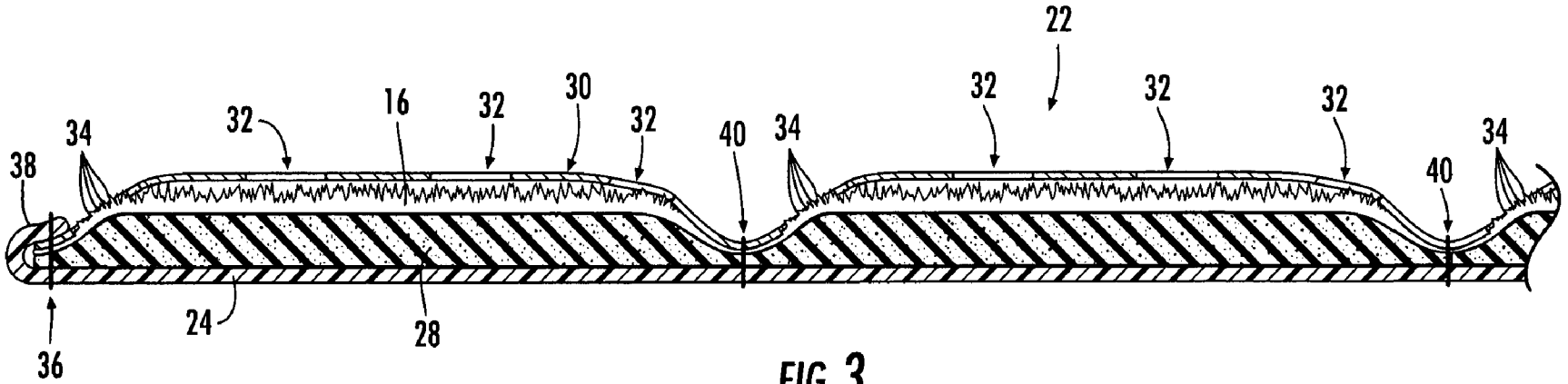
FIG. 3 is a cross sectional view of the scrubbing component of the subject golf towel.

Referring now to FIG. 3, a cross-sectional view of a portion of scouring apparatus 22 is provided to better illustrate the various layers thereof. Water retention means in the form of a sheet of natural or synthetic sponge 28, or other material having similar absorbency characteristic such as porous plastics, rubber and the like, is disposed between second panel 16 and backing 24. A sheet of an abrasive web-like mesh 30 made of nylon or other like material selected for its durability, water resistance and abradingness overlays the lower portion of second panel 16 that is integrated with the other components of the scouring apparatus 22. The surface texture of mesh 30 is suitable for removing dirt, grass, sand and other debris from the grooves 102 of a golf club face (FIG. 1). Moreover, mesh 30, by definition, is perforated in nature having a plurality of apertures 32 through which at least one of the finger-like closed loops 34 of the terry cloth material project, together forming a grid-like duel-textured surface that has both abrasive (mesh 30) and polishing (terry cloth 16) functionality. When a solvent such as water is added to sponge 28 and overlying portions of second panel 16, cleaning performance is further enhanced because the subject apparatus may be caused to simultaneously deliver abrading and polishing action with moisture to a target object.

Mesh 30, underlying lower portion of second panel 16, underlying sponge 28 and underlying backing 24 are stitched together about their perimeters using perimeter stitching 36. Backing 24 may be oversized such that its outer edge 38 may be folded over the edges of mesh 30, second panel 16, and sponge 28 as illustrated in FIG. 1 to impart a neat appearance, prevent fraying and to provide additional durability. Those portions of mesh 30, second panel 16, and sponge 28 within their perimeters are stitched together using field stitching 40. Note that backing 24 contains no field stitching which might otherwise interfere with non-permeability and surface printing of indicia. Note further that field stitching 40 is sewn so as to produce a plurality of billows 42, through the technique of tying, which increases the durability of scouring apparatus 22 by inhibiting tears from running across the entire field as may be appreciated by those skilled in the art.

It should be appreciated that the scouring apparatus 22 may also have utility by itself, without a toweling member attached thereto (FIG. 1) although having a length of dry toweling associated with scouring apparatus 22 is preferred, especially in golf equipment cleaning applications. Other embodiments include the above-described scouring apparatus 22 having toweling members depending from one, two, three or all of its perimeter edges, any or all of said toweling members being attached to scouring apparatus 22 or being an extension of the panel of toweling that is part of the scouring apparatus itself.

Method of Use

In use, scouring apparatus 22 is first soaked in water or a soap and water mixture to saturate or partially saturate sponge 28 and that portion of second panel 16 within scrubbing component 22. Excess water may be removed by light shaking of the apparatus. Backing 24 will quickly shed water and dry to provide a clean and dry gripping surface through which water from the adjacent wet sponge may not penetrate. The user may handle, fold or otherwise manipulate scouring apparatus 22, such as while cleaning a target object, by grasping backing 24 as illustrated in FIG. 1. All dirt and debris removed from the target object will remain on the cleaning surface on the opposite side of the scouring apparatus 22. Backing 24, therefore protects the user's hands from dirt, moisture, cleaning agents and other chemicals such as fertilizer while the opposing mesh layer permits delivery of moisture from sponge 28 through its plurality of apertures 32 to the target object, such as a golf ball or golf club, via the finger-like projections 34 of second panel 16 projecting through said apertures. As may be appreciated, the subject apparatus provides a cleaning surface with combined abrading, polishing and moisture delivery capabilities which may all be delivered to the target object simultaneously. The target object may then be dried on either first panel 14 or on the dry portion of the second panel 16. When not in use, scrubbing component 22 depends from second panel 16 such that its wet and dirty cleaning surface comes into abutting engagement with first panel 14 rather than the underlying golf bag 100.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A cleaning apparatus, comprising:

a. a first panel of toweling;

b. a second panel of toweling at least partially overlapping said first panel of toweling; said second panel of toweling having a first side facing said first panel of toweling and a second side facing away from said first panel of toweling; said first side having a plurality of projections extending there from;

c. an abrading mesh overlaying at least a portion of said first side of said second panel of toweling; said mesh having a plurality of apertures through which at least one of said plurality of projections extends;

d. a waterproof backing opposite said at least a portion of said first side of said second panel of toweling; and e. water retention means disposed between said at least a portion of said first side of said second panel of toweling and said waterproof backing;

whereby the apparatus has combined abrading, polishing and moisture delivery capabilities which may all be caused to act upon a target object simultaneously while shielding the user from wet and soiled surfaces.

2. The cleaning apparatus of claim 1 wherein at least one of said first panel of toweling and said second panel of toweling is constructed of terry cloth.

3. The cleaning apparatus of claim 2 wherein said first panel of toweling and said second panel of toweling are formed by folding a single panel of toweling over upon itself.

4. The cleaning apparatus of claim 3 wherein said second panel of toweling has a curved end.

5. The cleaning apparatus of claim 4 wherein said water retention means is a sponge.

6. The cleaning apparatus of claim 3 wherein said water retention means is a sponge.

7. The cleaning apparatus of claim 3 further including mounting means to facilitate attachment to a golf bag or golf cart.

8. The cleaning apparatus of claim 2 wherein said second panel of toweling has a curved end.

9. The cleaning apparatus of claim 8 wherein said water retention means is a sponge.

10. The cleaning apparatus of claim 2 wherein said water retention means is a sponge.

11. The cleaning apparatus of claim 2 further including mounting means to facilitate attachment to a golf bag or golf cart.

12. The cleaning apparatus of claim 1 wherein said first panel of toweling and said second panel of toweling are formed by folding a single panel of toweling over upon itself.

13. The cleaning apparatus of claim 12 wherein said second panel of toweling has a curved end.

14. The cleaning apparatus of claim 13 wherein said water retention means is a sponge.

15. The cleaning apparatus of claim 12 wherein said water retention means is a sponge.

16. The cleaning apparatus of claim 12 further including mounting means to facilitate attachment to a golf bag or golf cart.

17. The cleaning apparatus of claim 1 wherein said second panel of toweling has a curved end.

18. The cleaning apparatus of claim 17 wherein said water retention means is a sponge.

19. The cleaning apparatus of claim 1 wherein said water retention means is a sponge.

20. The cleaning apparatus of claim 1 further including mounting means to facilitate attachment to a golf bag or golf cart.

* * * * *